US011162335B2

(12) United States Patent
Gartz et al.

(10) Patent No.: US 11,162,335 B2
(45) Date of Patent: Nov. 2, 2021

(54) SAFE FIRING HEAD FOR DEVIATED WELLBORES

(71) Applicant: OWEN OIL TOOLS LP, Houston, TX (US)

(72) Inventors: Jeffrey D. Gartz, Lacombe (CA); Timothy E. Lagrange, Ponoka (CA)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 16/760,337

(22) PCT Filed: Oct. 31, 2017

(86) PCT No.: PCT/US2017/059350

§ 371 (c)(1),
(2) Date: Apr. 29, 2020

(87) PCT Pub. No.: WO2019/089010

PCT Pub. Date: May 9, 2019

(65) Prior Publication Data

US 2021/0207460 A1 Jul. 8, 2021

(51) Int. Cl.
*E21B 43/1185* (2006.01)
*F42C 15/34* (2006.01)

(52) U.S. Cl.
CPC ..... *E21B 43/11855* (2013.01); *F42C 15/34* (2013.01)

(58) Field of Classification Search
CPC ..... E21B 43/11855; F42C 15/34
See application file for complete search history.

(56) References Cited

U.S. PATENT DOCUMENTS

2012/0138286 A1* 6/2012 Mason ..... E21B 43/1185 166/55.2
2015/0292850 A1* 10/2015 Davidson ..... F42C 15/34 102/206

* cited by examiner

*Primary Examiner* — Robert E Fuller
(74) *Attorney, Agent, or Firm* — Mossman Kumar & Tyler PC

(57) ABSTRACT

A firing head for selectively activating an initiator of a downhole tool may include a housing, a pin, and a moveable stopper. The housing may have a bore and a radially enlarged chamber formed along the bore. The pin is disposed in the bore and has a circumferential groove formed on an outer surface of the shank. The moveable stopper is disposed in the radially enlarged chamber. The stopper is only partially disposed in the groove when the housing is in a vertical position. The stopper moves out of the groove when the housing has a predetermined minimum angular deviation from the vertical position.

15 Claims, 6 Drawing Sheets

SAFE FIRING HEAD FOR DEVIATED WELLBORES

TECHNICAL FIELD

The present disclosure relates to firing heads for actuating downhole tools.

BACKGROUND

One of the activities associated with the completion of an oil or gas well is the perforation of a well casing. During this procedure, perforations, such as passages or holes, are formed in the casing of the well to enable fluid communication between the wellbore and the hydrocarbon producing formation that is intersected by the well. These perforations are usually made with a perforating gun loaded with shaped charges. The gun is lowered into the wellbore on electric wireline, slickline or coiled tubing, or other means until it is at a desired target depth; e.g., adjacent to a hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow from the formation through the perforations and into the production string for flowing to the surface.

Many oil well tools use firing heads to initiate a detonation train during a desired well operation. For well operations that require the oil well tool to be in a deviated orientation, the present disclosure provides methods and devices for ensuring the firing heads of such tools do not initiate a detonation train unless the desired orientation is present.

SUMMARY

In aspects, the present disclosure provides a firing head for selectively activating an initiator of a downhole tool. The firing head may include a housing, a pin, and a moveable stopper. The housing may have a bore and a radially enlarged chamber formed along the bore. The pin is disposed in the bore and has a circumferential groove formed on an outer surface of the shank. The moveable stopper is disposed in the radially enlarged chamber. The stopper is only partially disposed in the groove when the housing is in a vertical position. The stopper moves out of the groove when the housing has a predetermined minimum angular deviation from the vertical position.

In further aspects, the present disclosure provides a method for selectively activating an initiator of a downhole tool using the above-described firing head. The method may include forming a downhole tool by positioning the firing head adjacent to the initiator; conveying the downhole tool into a wellbore, wherein the stopper prevents the pin from contacting the initiator unless the predetermined angular deviation is present; positioning the downhole tool at a desired location where the predetermined angular deviation is present; and activating the initiator using the firing head.

It should be understood that examples certain features of the disclosure have been summarized rather broadly in order that the detailed description thereof that follows may be better understood, and in order that the contributions to the art may be appreciated. There are, of course, additional features of the disclosure that will be described hereinafter and which will in some cases form the subject of the claims appended thereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION

Figure 1:
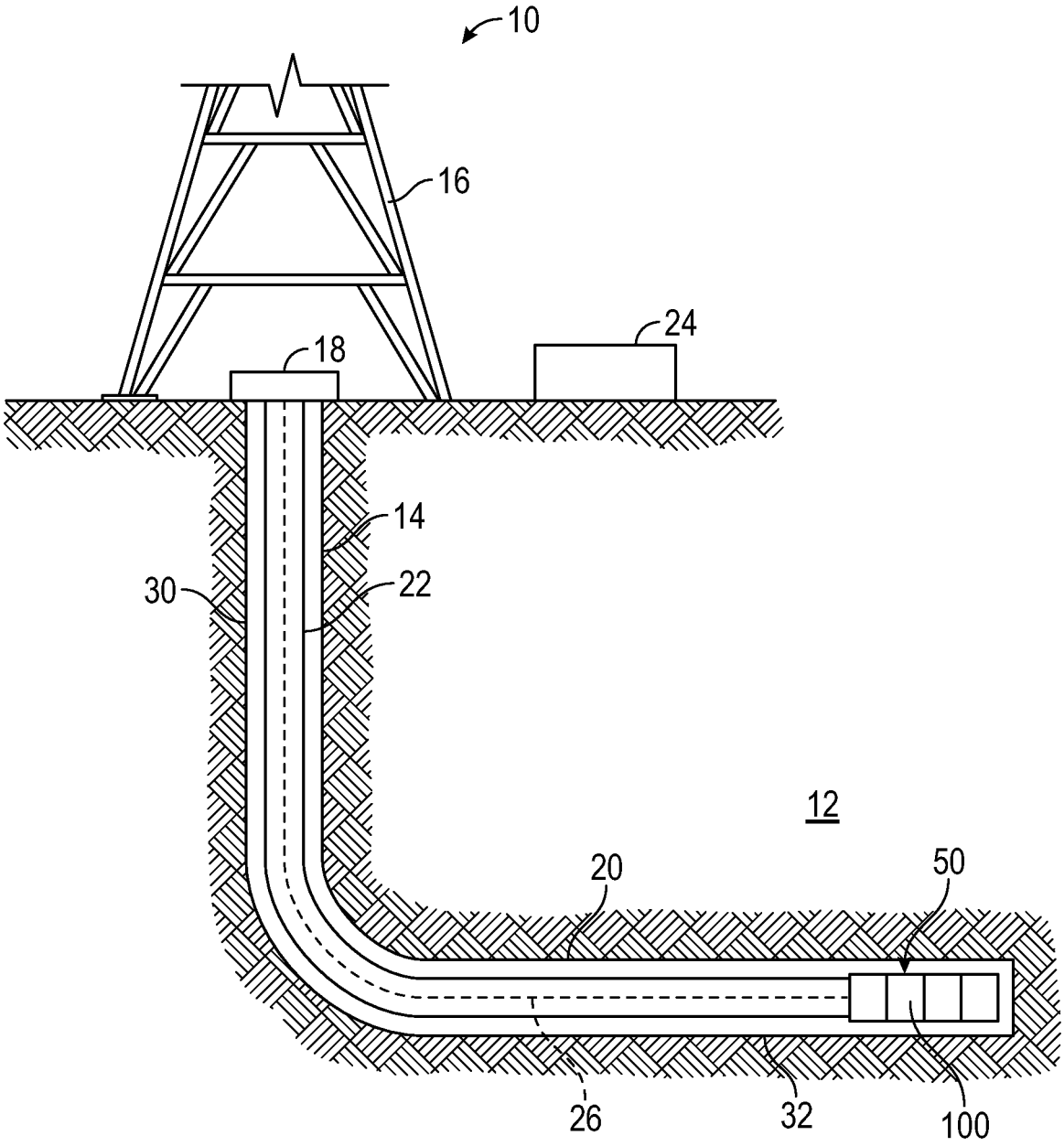
FIG. 1 schematically illustrates an elevation view of a surface facility adapted to perform one or more pre-defined tasks in a wellbore using one or more downhole tools.

The present disclosure relates to a firing head for detonating downhole tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring to FIG. 1, there is shown a well construction and/or hydrocarbon recovery facility 10 positioned over a subterranean formation of interest 12. The facility 10 can include known equipment and structures such as a rig 16, a wellhead 18, and cased or uncased pipe/tubing 20. A work string 22 is suspended within the wellbore 14 from the rig 16. The work string 22 can include drill pipe, jointed tubing, coiled tubing, wire line, slick line, or any other known conveyance means. The work string 22 can include telemetry lines or other signal/power transmission mediums that establish one-way or two-way telemetric communication. A telemetry system may have a surface controller (e.g., a power source) 24 adapted to transmit electrical signals via a cable or signal transmission line 26 disposed in the work string 22. To perform one or more tasks in the wellbore 14, the work string 22 may include a downhole tool 50 that is activated by a firing head 100.

Conventionally, the downhole tool 50 is conveyed by the work string 22 along the various sections of the wellbore 14 until a desired target depth is reached. The wellbore 14 may have a complex geometry that includes one or more vertical sections 30 and one or more deviated sections 32. While shown as perfectly vertical and perfectly horizontal, the vertical sections 30 and the deviated sections 32 may vary in actual angular offset from a vertical datum, which is in the direction of gravity. In some instances, the target depth is in the deviated section 32 of the wellbore 14. As discussed below, firing heads according to the present disclosure are only operable after the downhole tool 50 is at a desired deviated orientation; e.g., horizontal.

Figure 2:
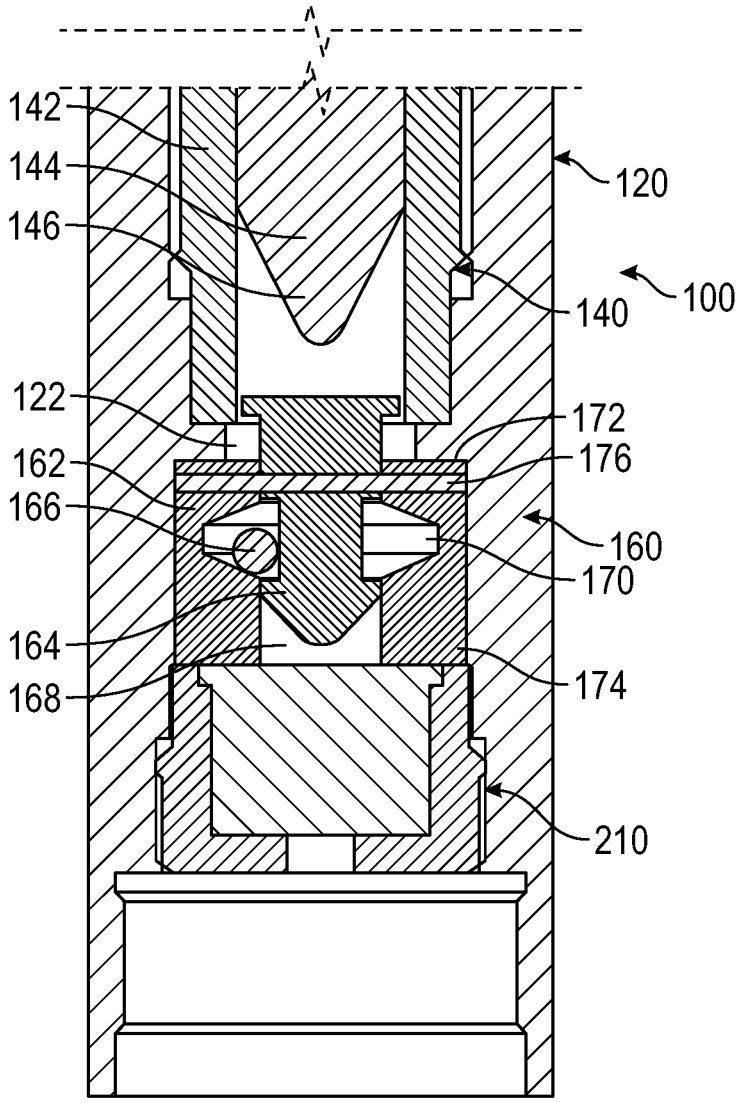
FIG. 2 illustrates a side sectional view of a firing head according to one embodiment of the present disclosure in a vertical orientation.

Referring to FIG. 2, there is sectionally illustrated one non-limiting embodiment of a firing head 100 made in accordance with the present disclosure that prevents a detonation train from being created until the downhole tool 50 (FIG. 1) is in a desired deviated orientation. In one embodiment, the firing head 100 may include an outer housing 120, a percussion assembly 140, a pin assembly 160, and an initiator 210. The percussion assembly 140, the pin assembly 160, and the initiator 210 are serially, or an "end-to-end" arrangement, disposed in a bore 122 of the outer housing 120. The serial arrangement enables the transfer of kinetic energy that is used to impact and detonate the initiator 210, which may include one or more high-explosives, such as RDX (Hexogen, Cyclotrimethylenetrinitramine), HMX (Octagon, Cyclotetramethylenetetranitramine), CLCP, HNS, and PYX.

In one embodiment, the percussion assembly 140 uses an impact to transfer kinetic energy to the pin assembly 160. The percussion assembly 140 may include a sleeve or tube 142 that receives a sliding contact member 144. The contact member 144 may be shaped as a solid cylinder with a blunt nose 146 and an opposing end (not shown). Application of force to the opposing end (not shown) drives the contact member 144 toward the pin assembly 160. The force may be applied by a hydrostatic pressure in the wellbore, by an impact from a projectile, or a detonation.

The pin assembly 160 selectively blocks the transfer of kinetic energy to the initiator 210 if a desired deviated orientation is not present. When, as shown, the stopper 166 prevents the pin assembly 160 from contacting the initiator 210, then the firing head 100 is in the "safe" position/condition. The pin assembly 160 may include a housing 162, a firing pin 164, and a free moving stopper 166. The housing 162 may be a cylindrical body through which a bore 168 is formed. The firing pin 164 can translate in a sliding fashion along the bore 168. The housing 162 also includes a medial chamber 170, which is a radial enlargement of the bore 168 in which the stopper 166 is positioned. The housing 162 may include an input face 172 facing the percussion assembly 120 and an output face 174 facing the initiator 210. The firing pin 164 is configured to travel in a direction from the input face 172 to the output face 174 upon impact of the contact member 144. To ensure that other types of impact or motion do not unintentionally move the firing pin 164, a frangible element 176, such as a shear pin, holds the firing pin 164 stationary to the housing 162. The frangible element 176 is an element that is intentionally designed to break upon encountering a predetermined force. In one embodiment, the frangible element 176 is received into complementary transverse bore formed in the firing pin 164 and in the housing 162.

Figure 3A:
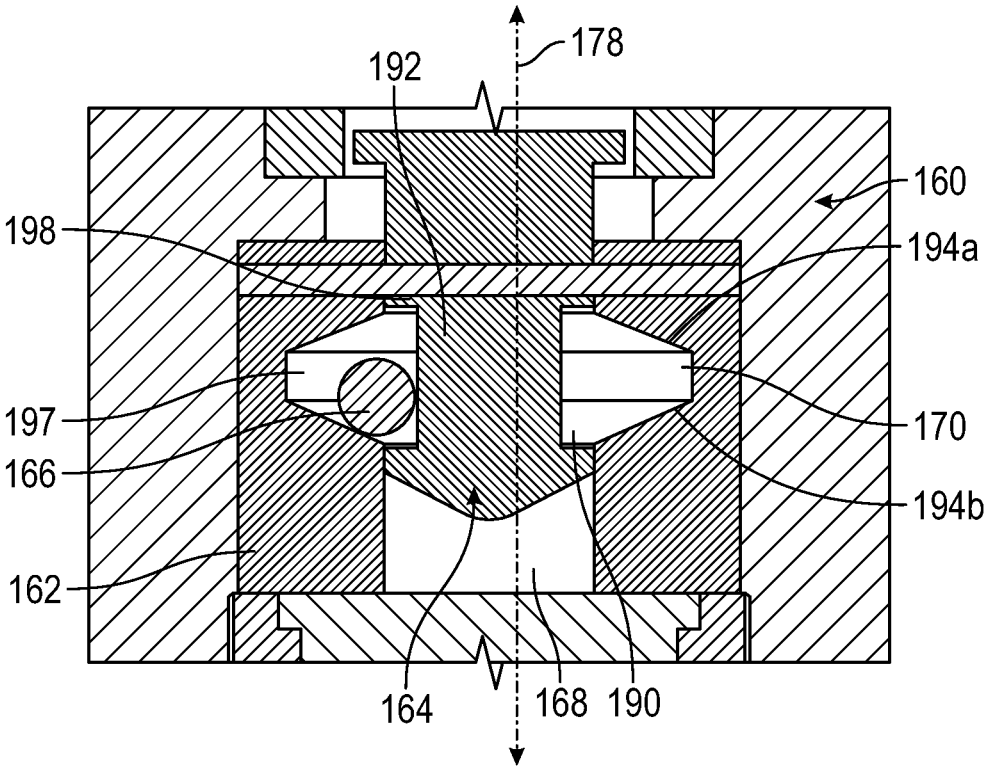
FIG. 3A illustrates an enlarged side sectional view of the pin assembly of FIG. 2.

FIG. 3A is an enlarged view of the pin assembly 160. In one arrangement, the stopper 166 is configured to allow the firing pin 164 to have unimpeded axial motion to contact and detonate the initiator 210 (FIG. 1) only after a longitudinal tool axis 178 of the pin assembly 160 has a predetermined angular deviation from a gravity vector, which defines a vertical direction. If the desired angular deviation is not present, then the stopper 166 stops the firing pin 164 from moving toward the initiator 210 (FIG. 1). Thus, the firing head 100 is in the "safe" position/condition. The stopping action occurs through the physical interaction of a groove 190 formed on a shank 192 of the firing pin 164, the stopper 166, and the medial chamber 170. The groove 190 is partially defined by a ledge 198 that can be contacted by the stopper 166 under specific circumstances described below. In one arrangement, the medial chamber 170 is defined by converging sloped surfaces 194*a,b*. Both surfaces 194*a,b* are non-orthogonal to the axis 178 and converge to one another in a radially outward direction. Both surfaces 194*a,b* have a slope sufficient to allow gravity to roll, slide, or pivot the stopper 166 into the groove 190 when the longitudinal axis 178 is parallel with gravity.

The stopper 166 may be a freely moving body that can be moved (e.g., slide, roll, rock, pivot, etc.) by gravity. By "freely moving" or "movable," it is meant that the stopper 166 is not fixed, connected, or otherwise restricted from moving along a surface due to gravitational attraction. The stopper 166 may be formed as a sphere, a spheroid, ovoid, cylinder, etc. The stopper 166 is sized only to partially seat in the groove 190. The stopper 166 may be formed of a metal, ceramic, polymer, or any other material that will maintain structural integrity when compressed between the ledge 198 and the sloped surface 194*a*. When part of the stopper 166 is in the groove 190 and the remainder of the stopper 166 is in the medial chamber 170, the stopper 166 prevents the firing pin 164 from moving a distance sufficient to strike and activate the initiator 210. Specifically, the stopper 166 acts as a physical barrier against which the ledge 198 strikes when then firing pin 164 slides toward the initiator 210. In the illustrated embodiment, the stopper 166 is shown radially offset from the longitudinal axis 178 and is smaller in size than the bore 168 of the housing 162. While one stopper 166 is shown, the stopper 166 may include two or more stopper elements.

Figure 3B:
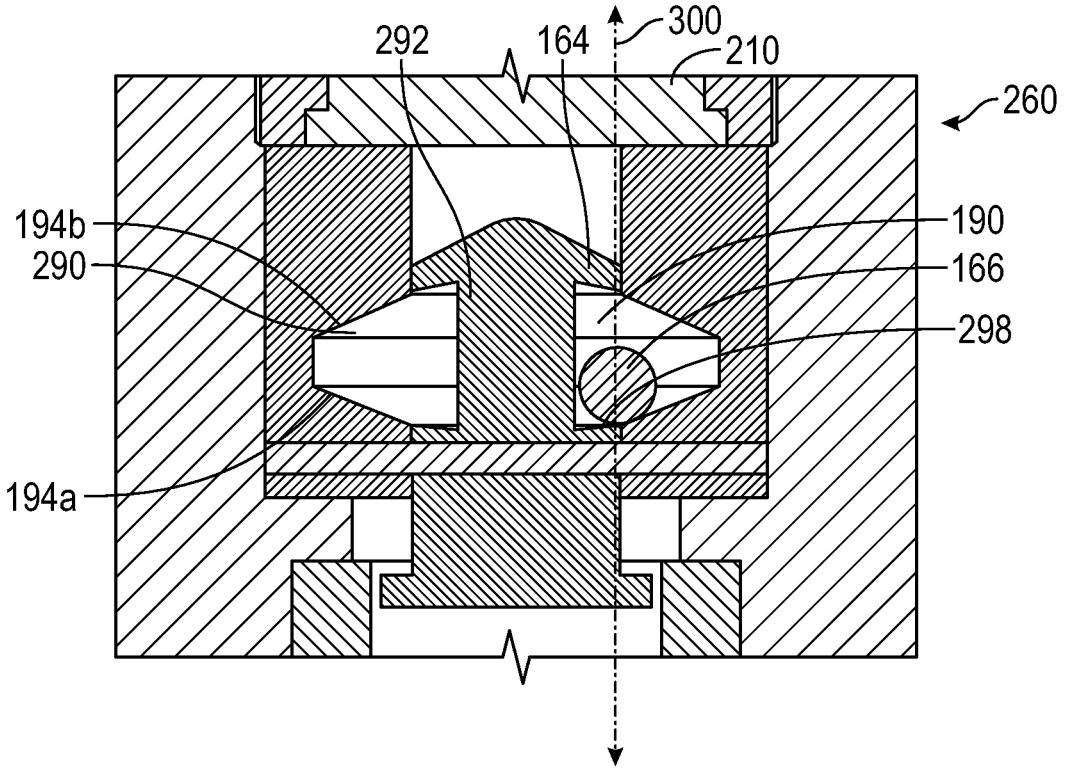
FIG. 3B illustrates an enlarged side sectional view of another embodiment of a pin assembly according to the present invention that is oriented in an upside down orientation.

FIG. 3B is an enlarged view of another pin assembly 260 according to the present disclosure. Whereas the pin assembly 160 of FIG. 3A is shown in an "upright" position or orientation, the pin assembly 260 of FIG. 3B is shown in an "upside down" orientation. In the "upright" position, the pin 164 of FIG. 3A moves downward with gravity. In the "upright" position, the pin 164 of FIG. 3B moves upward against gravity.

The pin assembly 260 is generally of the same configuration as the pin assembly 160 of FIG. 3A. However, the groove 290 formed on the shank 292 forms a recess that is radially wide enough to fit a majority of the stopper 166 or at least enough of the stopper 166 to have a center of gravity of the stopper 166 radially inward of an edge of a shoulder 298 on which the stopper 166 seats in the upside down orientation. The line 300 illustrates a line that intersects the center of gravity of the stopper 166. The shoulder 298 may have an undercut or sloped surface that is angled to have the stopper 166 move toward the shank 292. In operation, if the pin assembly 260 is in an undesirable deviated orientation, then the stopper 166 is seated in the shoulder 298. If the pin 164 unintentionally moves, then the stopper 166 is lifted by the shoulder 298 until the stopper 166 contacts the surface 194*b*. In embodiments, the shoulder 298 may include a lip, projection, rim or other feature that presents a wall or other structure that retains the stopper 166 within the shoulder 298 during the lifting.

Figure 4:
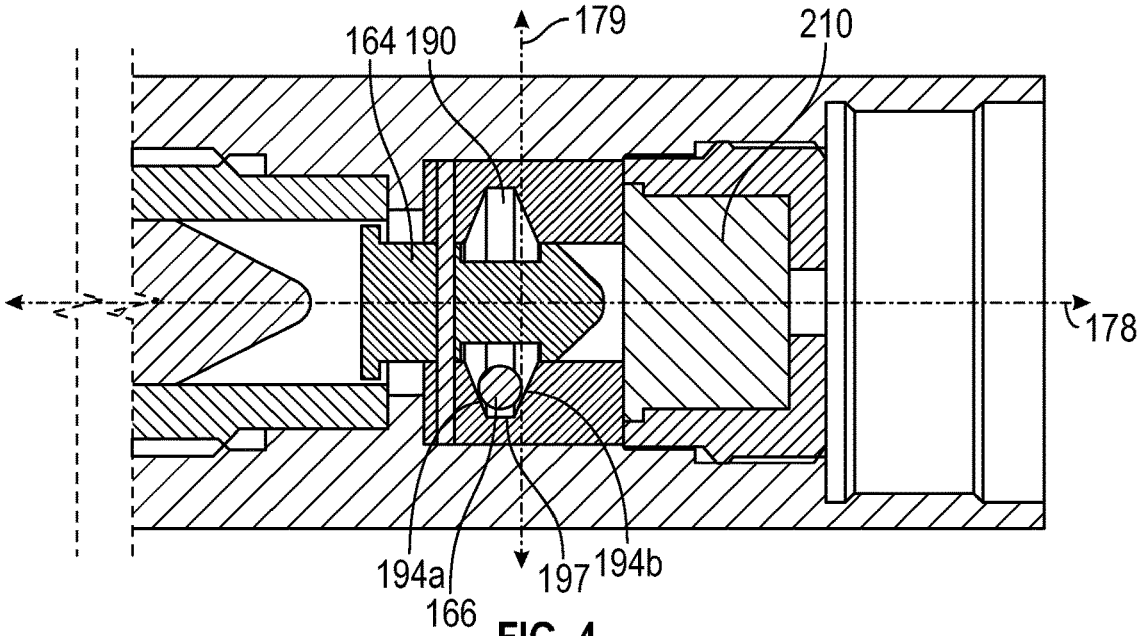
FIG. 4 illustrates an embodiment of a firing head according to the present disclosure that is in a ready to fire position.

Referring to FIG. 4, the pin assembly 160 is shown in a horizontal orientation wherein the longitudinal axis 178 is roughly orthogonal to the gravity vector 179. The axial distances separating the surfaces 194*a,b* and the angle defined by the surfaces 194*a,b* form a recess 197. The recess 197 may be partial or complete annular space formed in the chamber 710. The recess 197 may be sized to seat the stopper 166 in the medial chamber 170 such that no portion of the stopper 166 protrudes into the groove 190 to a degree that interferes or blocks the sliding motion of the firing pin 164.

Figure 5A:
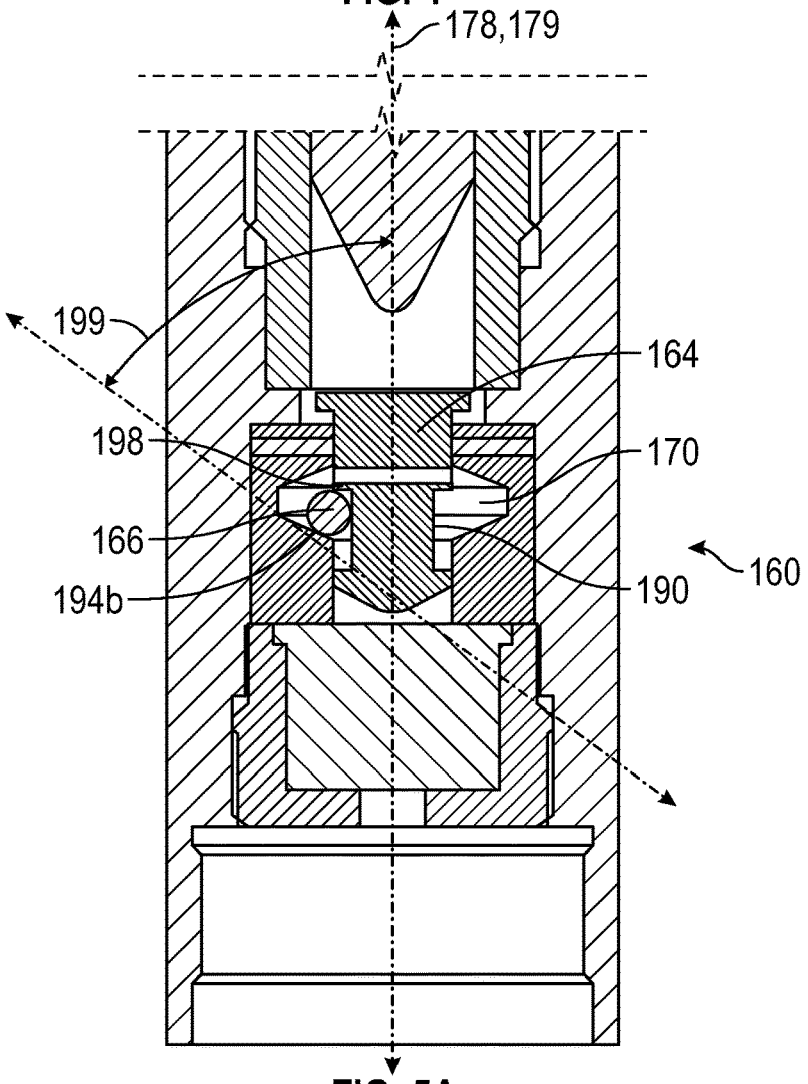
FIGS. 5A and B illustrates the FIG. 2 embodiment in a "safe" position while vertical and deviated, respectively.

Referring to FIG. 5A, the pin assembly 160 is shown in a vertical orientation relative to the gravity vector 179, which is co-linear with the longitudinal axis 178. This orientation may be indicative of a location in a wellbore where a detonation should not occur. Advantageously, the surface 194*b* has an angle 199 relative to the gravity vector 179 that enables gravity to keep the stopper 166 at least partially seated in the groove 190 in this vertical orientation. In effect, the stopper 166 has slid, rolled, or otherwise descended along the surface 194*b* to the "low point" in the chamber 170. Thus, as shown, the stopper 166 contacts and interferingly engages the firing pin 164 at the ledge 198 while being supported by surface 194*b*.

Figure 5B:
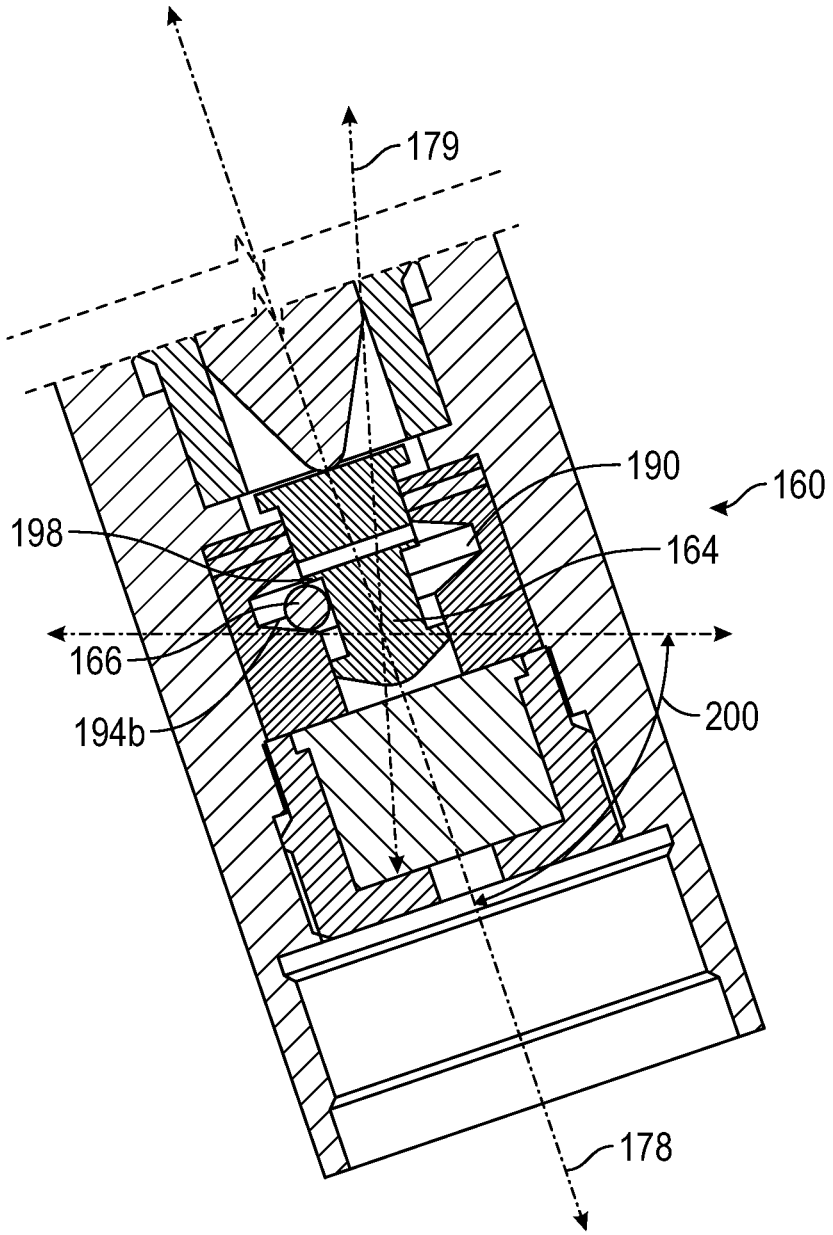

Referring to FIG. 5B, the pin assembly 160 is shown in a deviated orientation relative to the gravity vector 179. This deviated orientation may be indicative of a location in a wellbore where a detonation also should not occur. Advantageously, the angle 200 relative to the longitudinal axis 178 continues to enable gravity to keep the stopper 166 at least partially seated in the groove 190 despite the deviated orientation. Thus, as shown, the stopper 166 contacts and interferingly engages the firing pin 164 at the ledge 198. It should be appreciated that the angular deviation from the gravity vector 179 after which the pin assembly 160 becomes fully functional can be readily adjusted by selecting an appropriate angle 200 for one or both of the surfaces 194*a,b*. That is, the more acute the angle, the greater the deviation required to have the stopper 166 completely out of the groove 190.

One illustrative use of the firing head 100 will be discussed in connection with FIGS. 1-7. For clarity, the firing head 100 will be discussed with reference to perforating guns. It should be appreciated, however, that the firing head 100 is not limited to such use.

In one mode of use, the firing head 100 is incorporated into the tool 50. Initially, the downhole tool 50 may be conveyed along the vertical section 30 of the wellbore 14. In this section, the orientation of the firing head 100 may be less than the selected minimum value for a deviation. Therefore, if the firing pin 164 inadvertently slides toward the initiator 210 either due to being impacted by the contact member 144 or some other reason, the stopper 166 can obstruct movement of the firing pin 164 in the manner shown in FIGS. 5A-B. Thus, no detonation or detonation train is created because the firing head 100 is in the "safe" position/condition.

Figure 6:
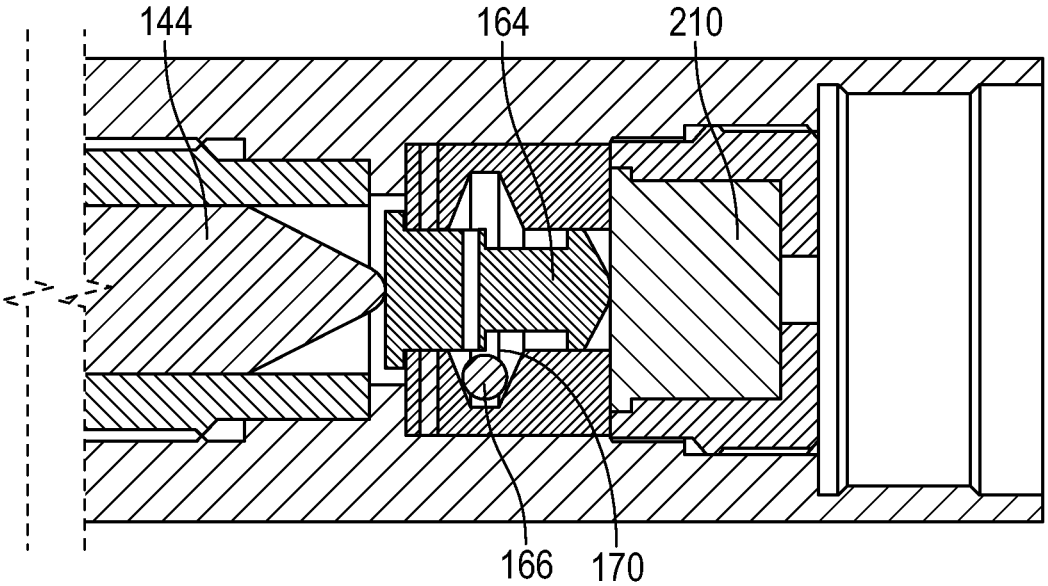
FIG. 6 illustrates the FIG. 2 embodiment in an "armed" position.

After the downhole tool 50 has reached the target depth at the deviated section 32 of the wellbore, the orientation of the firing head 100 may be at or greater than the selected minimum angular value for a deviation. The selected value for the minimum angular deviation may be a 15 degree, 30 degree, 45 degree, 60 degree, 75 degree, a 90 degree, or another intervening value. Therefore, gravity allows the stopper 166 to move completely out of the groove 190. As shown in FIG. 6, the stopper 166 is fully seated in the medial chamber 170. Therefore, upon contact by the contact pin 144, the firing pin 164 can travel axially unimpeded toward and strike the initiator 210. The firing head 100 may be considered to be in a "fire ready," "ready" or "armed" position/condition.

Figure 7:
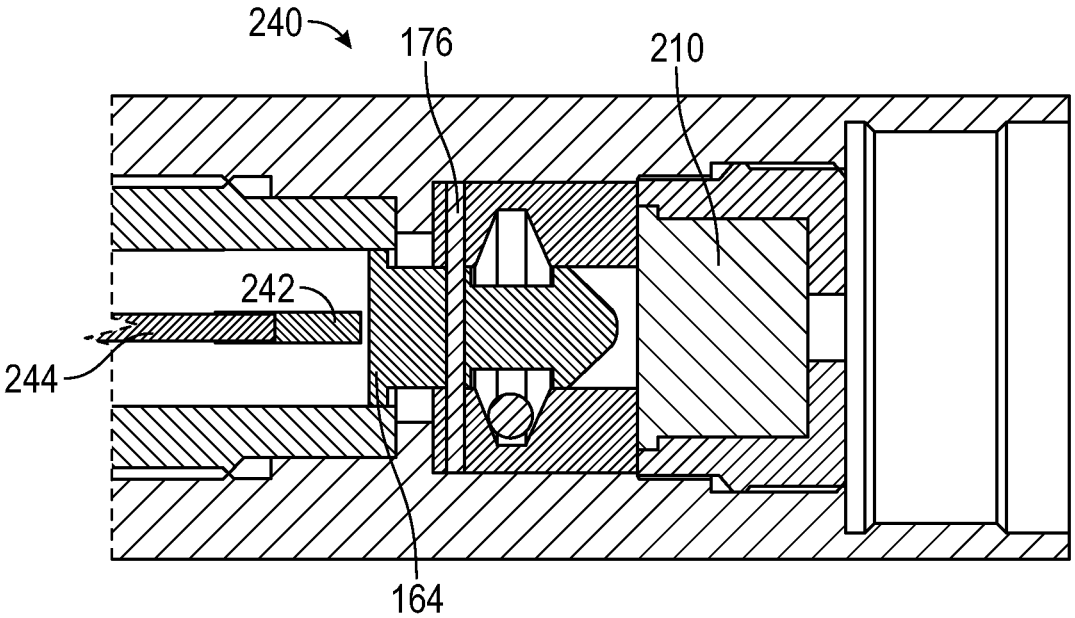
FIG. 7 illustrates a further embodiment of a percussion assembly according to the present disclosure.

FIG. 7, there is shown another percussion arrangement 240 to generate sufficient force to translate the firing pin 164. The percussion arrangement may include a booster charge 242 at a terminal end of a detonator cord 244. The booster charge 242 may include a quantity of energy material sufficient to generate a pressure wave with enough energy to break the frangible element 176 and propel the firing pin 164 into the initiator 210.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. A firing head for selectively activating an initiator of a downhole tool, comprising:

a housing having a bore and a radially enlarged chamber formed along the bore;

a pin disposed in the bore, the pin having a shank and a circumferential groove formed on an outer surface of the shank: and a moveable stopper disposed in the radially enlarged chamber, wherein the stopper is only partially disposed in the groove when the housing is in a vertical position, the stopper moving out of the groove when the housing has a predetermined minimum angular deviation from the vertical position.

2. The firing head of claim 1, wherein the stopper moves by at least one of: (i) rolling, and (ii) sliding.

3. The firing head of claim 1, wherein the stopper is shaped as one of: (i) a sphere, (ii) a spheroid, (iii) an ovoid, and (iv) a cylinder.

4. The firing head of claim 1, wherein the stopper includes a plurality of stopper elements.

5. The firing head of, claim 1, wherein the stopper has a center of gravity radially inward of an edge of a shoulder in which the stopper seats.

6. The firing head of claim 1, wherein the chamber is defined by at least one surface, the surface being sloped relative to a longitudinal axis of the housing to enable gravity to maintain the stopper in the groove when the housing is in the vertical position.

7. The firing head of claim 6, wherein the at least one surface is sloped to enable gravity to maintain the stopper in the groove when the housing is no greater than ten degrees deviated from the vertical position.

8. The firing head of claim 6, wherein the at least one surface is sloped to enable gravity to maintain the stopper in the groove when the housing is no greater than forty-five degrees deviated from the vertical position.

9. The firing head of claim 1, wherein the pin has a first end positioned to receive an applied force, and a second end configured to contact an initiator.

10. The firing head of claim 1, wherein the housing has an upright orientation and an upside down orientation, wherein the chamber is defined by a first surface and a second surface, wherein the first surface is sloped relative to a longitudinal axis of the housing to enable gravity to maintain the stopper in the groove when the housing is in the upright position, and the second surface is sloped relative to a longitudinal axis of the housing to enable gravity to maintain the stopper in the groove when the housing is in the upside down position.

11. A method for selectively activating an initiator of a downhole tool, comprising:

forming a downhole tool by positioning a firing head adjacent to the initiator, the firing head comprising:

a housing having a bore and a radially enlarged chamber formed along the bore;

a pin disposed in the bore, the pin having a shank and a circumferential groove formed on an outer surface of the shank: and a stopper disposed in the radially enlarged chamber, wherein the stopper is only partially disposed in the groove when the housing is in a vertical position, the stopper moving out of the groove when the housing has a predetermined angular deviation from the vertical position;

conveying the downhole tool into a wellbore, wherein the stopper prevents the pin from contacting the initiator unless the predetermined angular deviation is present;

positioning the downhole tool at a desired location where the predetermined angular deviation is present; and activating the initiator using the firing head.

12. The method of claim 11, wherein the stopper moves by at least one of: (i) rolling, and (ii) sliding.

13. The method of claim 11, wherein the stopper has a center of gravity radially inward of an edge of a shoulder in which the stopper seats.

14. The method of claim 11, further comprising applying a force to a first end of the pin, the pin moving in response to the applied force and contacting the initiator.

15. The method of claim 11, wherein the housing has an upright orientation and an upside down orientation, wherein the chamber is defined by a first surface and a second surface, wherein the first surface is sloped relative to a longitudinal axis of the housing to enable gravity to maintain the stopper in the groove when the housing is in the upright position, and the second surface is sloped relative to a longitudinal axis of the housing to enable gravity to maintain the stopper in the groove when the housing is in the upside down position.

* * * * *